US008491019B2

(12) United States Patent
Uyeda

(10) Patent No.: US 8,491,019 B2
(45) Date of Patent: Jul. 23, 2013

(54) ADJUSTABLE INSTALLATION OF DOOR LOCKING SYSTEM

(75) Inventor: Alan K. Uyeda, Irvine, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 213 days.

(21) Appl. No.: 12/658,173

(22) Filed: Feb. 5, 2010

(65) Prior Publication Data

US 2011/0192203 A1 Aug. 11, 2011

(51) Int. Cl.
*E05C 1/12* (2006.01)
*E05C 1/02* (2006.01)

(52) U.S. Cl.
USPC ..... 292/172; 292/137

(58) Field of Classification Search
CPC ..... E05B 47/0012; E05C 1/10
USPC ..... 292/7, 22, 32, 33, 34, 39, 137, 160, 292/172, 138, 142, 143
See application file for complete search history.

(56) References Cited

U.S. PATENT DOCUMENTS 2,676,051 A * 4/1954 Hillgren ..... 292/358
3,791,180 A 2/1974 Doyle
4,052,092 A * 10/1977 Bergen ..... 292/172
4,255,953 A * 3/1981 Dietrich et al. ..... 70/107
4,333,324 A * 6/1982 Dietrich et al. ..... 70/107
4,725,085 A * 2/1988 Hu et al. ..... 292/172
4,809,526 A * 3/1989 Shen ..... 70/107
4,934,800 A * 6/1990 Choi ..... 292/172
5,123,683 A * 6/1992 Solovieff ..... 292/172
5,513,510 A * 5/1996 Solovieff et al. ..... 70/472
5,992,188 A 11/1999 Saunders
7,003,990 B2 * 2/2006 Iliuk ..... 70/107
7,364,212 B1 * 4/2008 Fan ..... 292/336.3

OTHER PUBLICATIONS

Copenheaver, Blaine R., "International Search Report and the Written Opinion of the International Searching Authority," for application PCT/US2011/023523, filed Feb. 3, 2011, mailed Mar. 30, 2011, Alexandria, Virginia.

* cited by examiner

*Primary Examiner* — Thomas Beach
*Assistant Examiner* — Nathan Cumar
(74) *Attorney, Agent, or Firm* — Woods Oviatt Gilman LLP

(57) ABSTRACT

In a drive train between a door handle having a first axis of rotation and a rotary lock part carried on a door to have a second axis of rotation, the drive train accommodating to possible misalignment of those axes, the drive train including a carrier, a rack carried by the carrier, and movable in a first lateral direction in response to door handle rotation, a gear located to rotatably drive the rotary lock part in response to rack movement in the first lateral direction, relative to the carrier, and means to adjust the position of the rack in a second lateral direction, to compensate for mis-alignment of the first and second axes.

11 Claims, 9 Drawing Sheets

105
104
103
100
102b
101b

ADJUSTABLE INSTALLATION OF DOOR LOCKING SYSTEM

BACKGROUND OF THE INVENTION

This invention relates generally to door locking and unlocking devices, and more particularly to adapting such devices to non-alignment locking and unlocking elements.

There is need for simple, highly compact, durable and efficient door locking and unlocking devices, where deadbolts and latches are to be operated, as from the inner and outer sides of doors. In particular, there is need for improvements in mechanisms responsive to door handle turning, and incorporating means accommodating to non-aligning rotary drive train parts, as for example non-aligning axes of door handle and lock drives.

SUMMARY OF THE INVENTION

It is a major object of the invention to provide improvements in apparatus meeting the above needs.

Basically, a preferred locking drive train between a door handle having a first axis of rotation and a rotary lock part carried on a door to have a second axis of rotation, is provided, the drive train accommodating to possible misalignment of such axes, the drive train including:

a) a carrier, b) a rack carried by the carrier, and movable in a first lateral direction in response to door handle rotation, c) a spur gear located to rotatably drive the rotary lock part in response to rack movement in that one lateral direction, relative to the carrier, d) and means to adjust the position of the rack in a second lateral direction, to compensate for mis-alignment of the first and second axes.

As will be seen, such structure and functioning enables or facilitates door installation and operation for unlocking operation, by turning the handle either clockwise or counterclockwise, with the basic mechanism of the lock structure remaining unchanged.

As will be seen, the first and second axes are typically characterized by one of the following:

i) parallel ii) parallel and in alignment iii) parallel and misaligned iv) parallel and out of alignment due to their extending from a handle on the door, and from a door frame.

A further object includes provision of means on the carrier to support the rack for adjustable movement laterally relative to the carrier, to mesh with and rotate the spur gear, when the first and second axes are out of alignment. Such means typically includes with unusual advantage, $x_1$) a link having drive connection to the rack for movement in one lateral direction, and $x_2$) a cam movable by the door handle, to drive the link and rack in said one lateral direction.

As will be seen, the link advantageously has laterally spaced drive shoulders respectively engageable by the cam in response to cam rotation in opposite direction (clockwise or counterclockwise) by the door handle. Also, the link and rack may have tongue and groove connection to provide lost motion connection in a lateral direction, as well as positive connection in vertical direction.

Also, the carrier preferably includes a housing, and an adjustable cover adjustably attached to the housing, the cover guiding movement of the rack in said first lateral direction, the cover having selectable lateral positioning relative to the housing.

In these regards, objectives and structures defined in application Ser. No. 12/384,948 are incorporated herein, by reference.

These and other objects and advantages of the invention, as well as the details of an illustrative embodiment, will be more fully understood from the following specification and drawings, in which:

DRAWING DESCRIPTION

Figure 4:
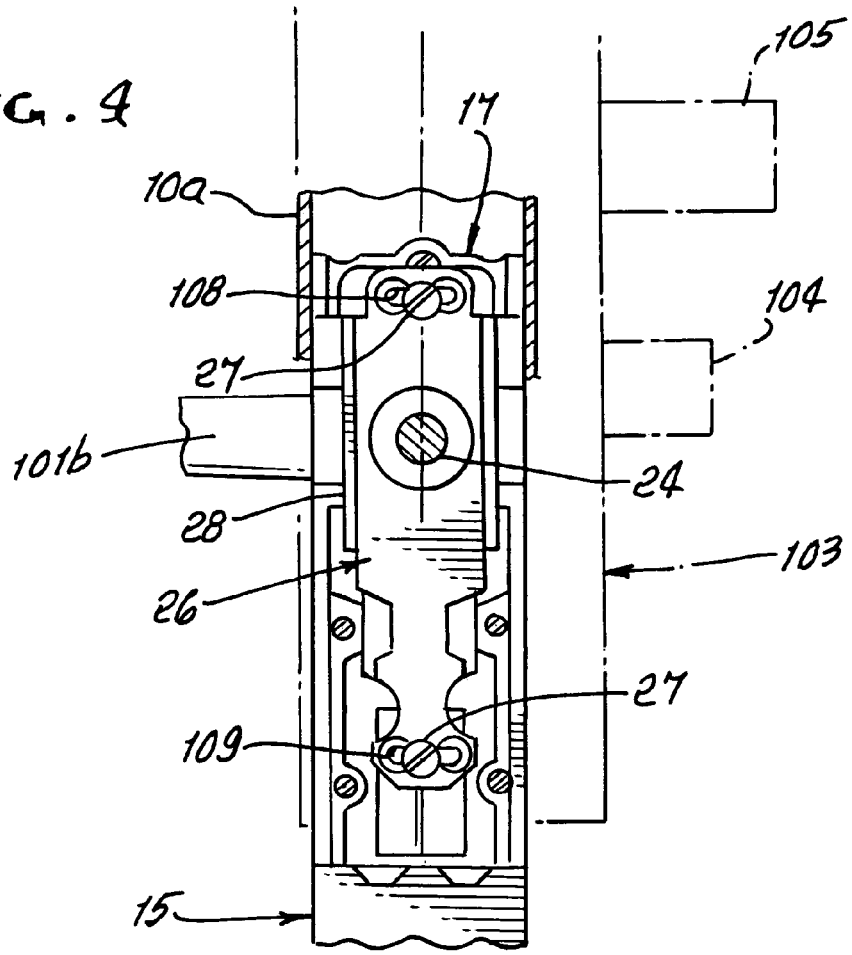
FIG. 4 is a section taken in elevation on lines 4-4 of FIG. 1.
Figure 5:
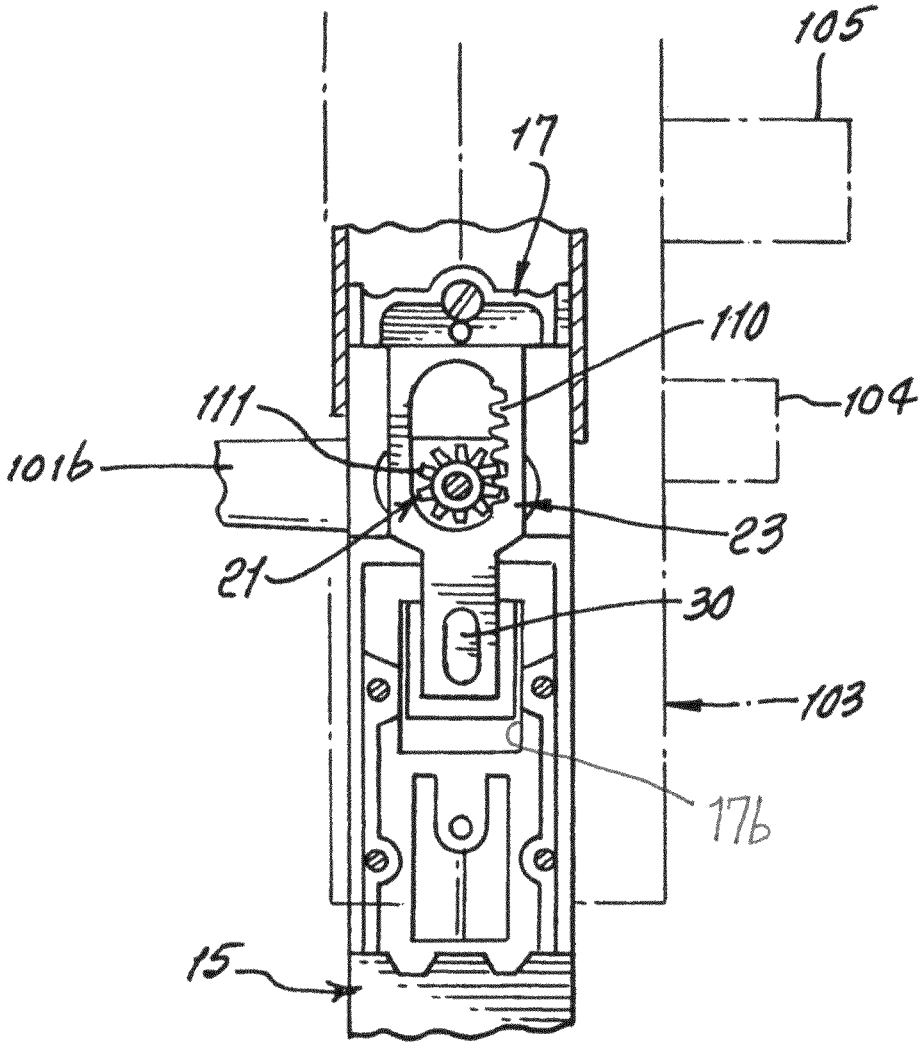
FIG. 5 is a view similar to FIG. 4, showing lock interior structure after removal of an adjustable cover.
Figure 9A:
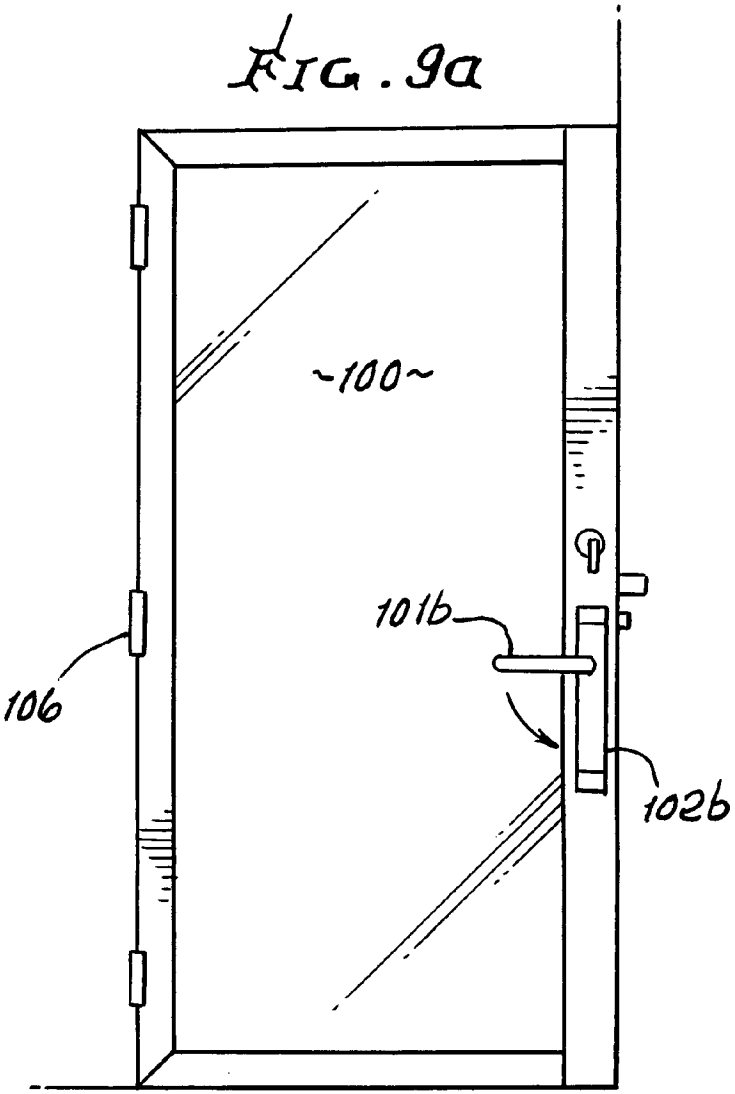
Figure 5A:
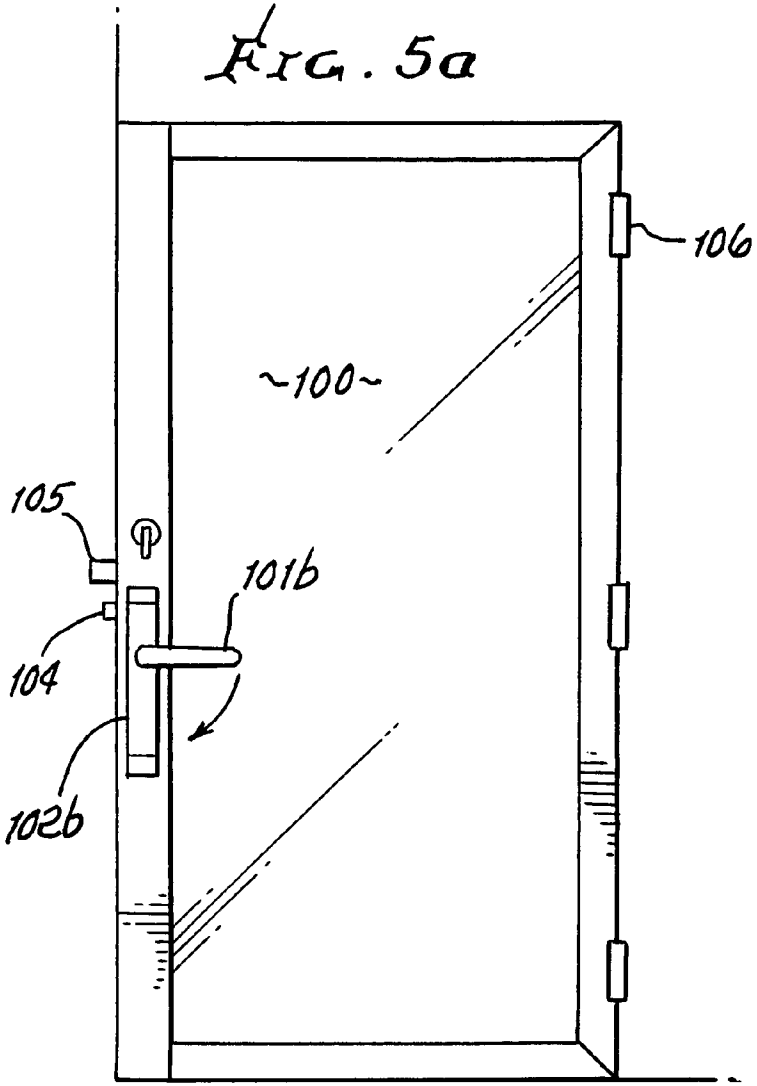
Figure 6:
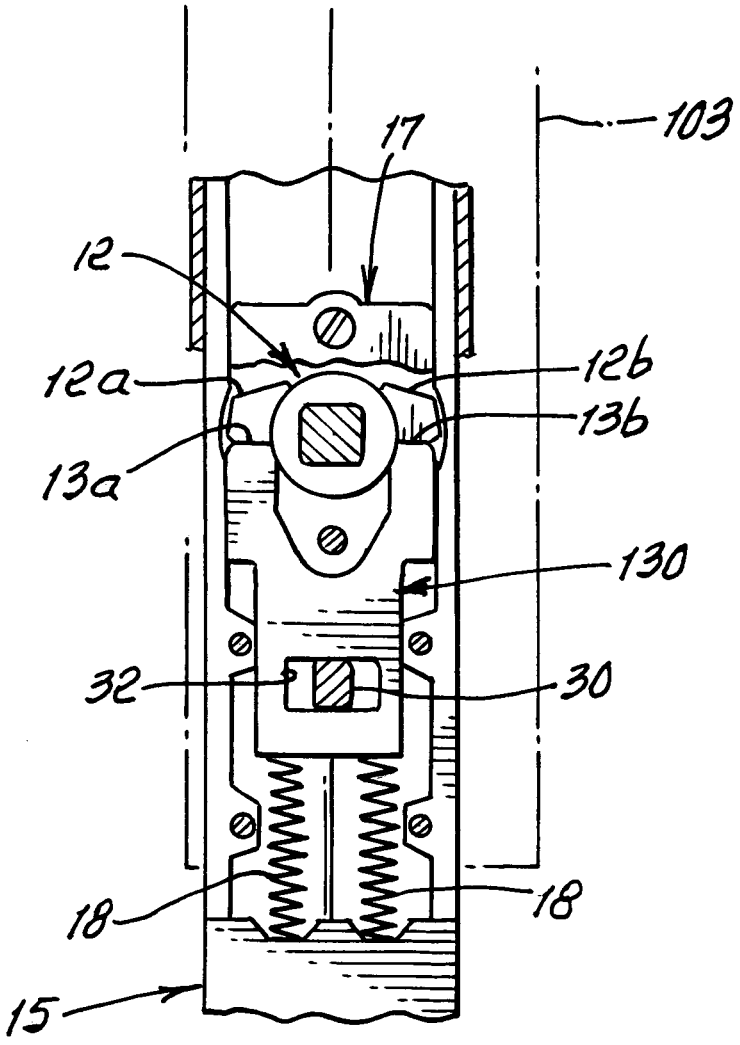
Figure 8:
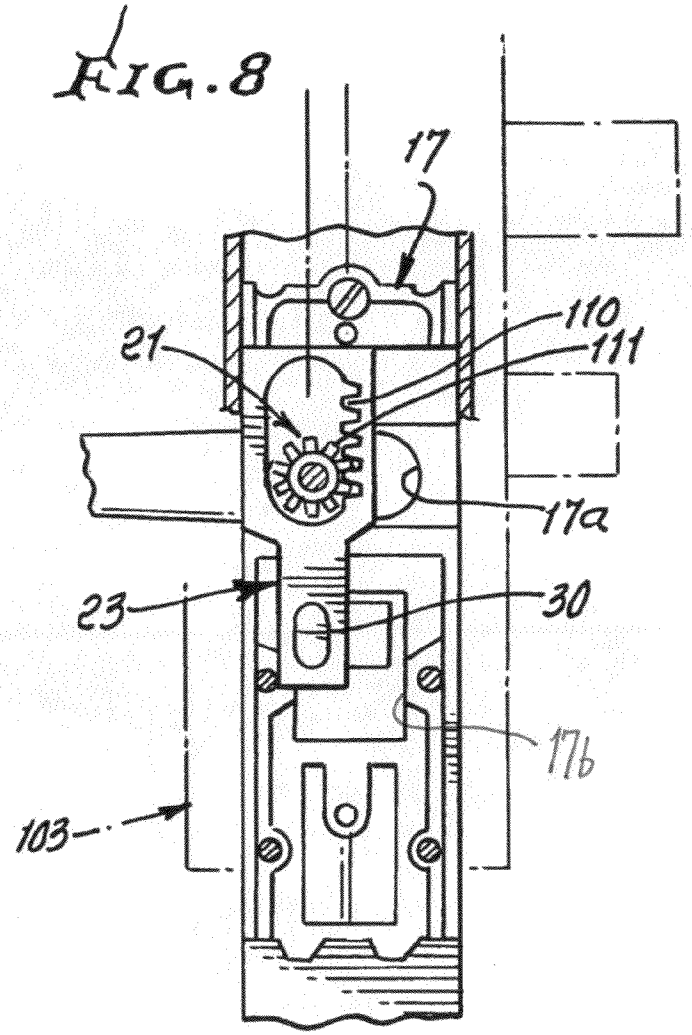
Figure 7:
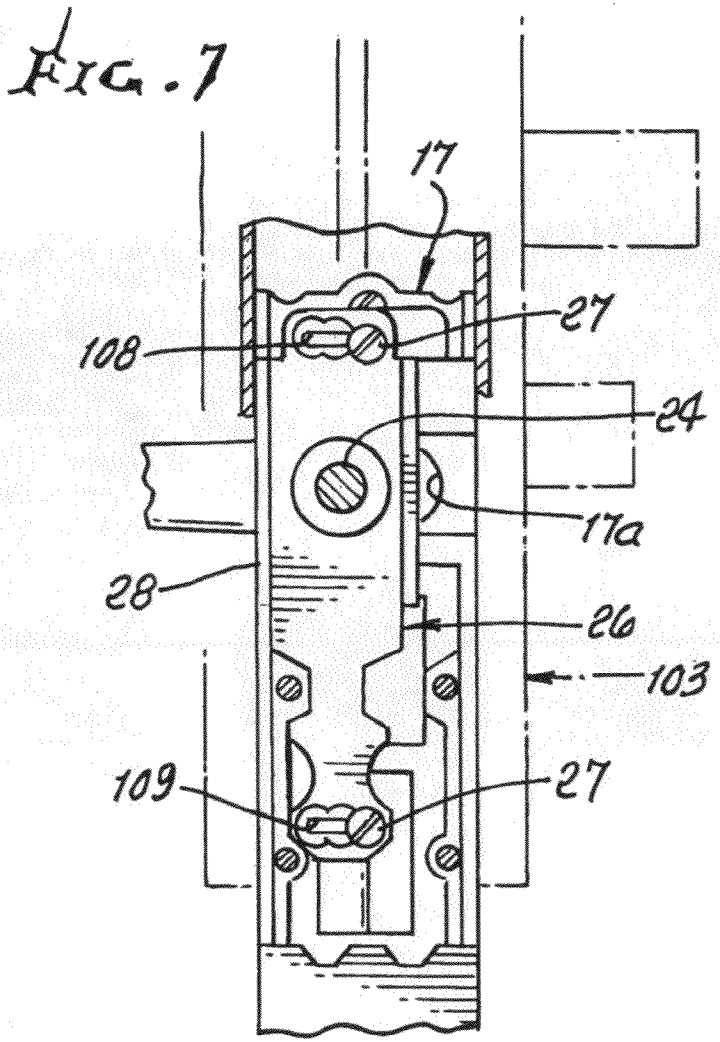
Figure 9:
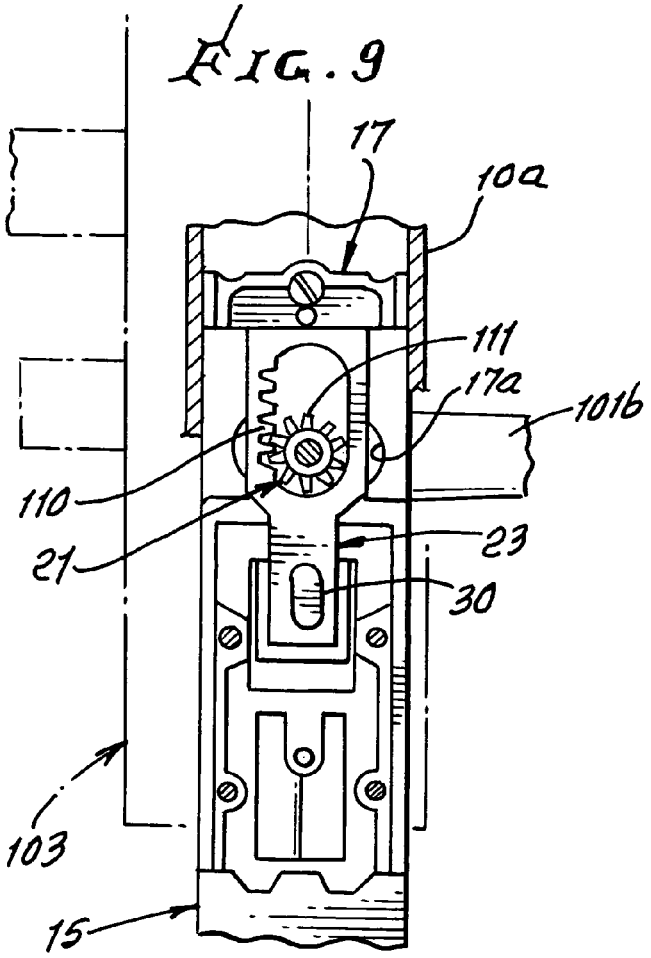
Figure 10:
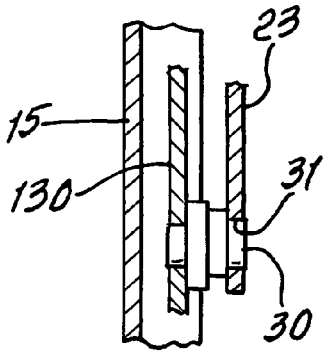
Figure 11:
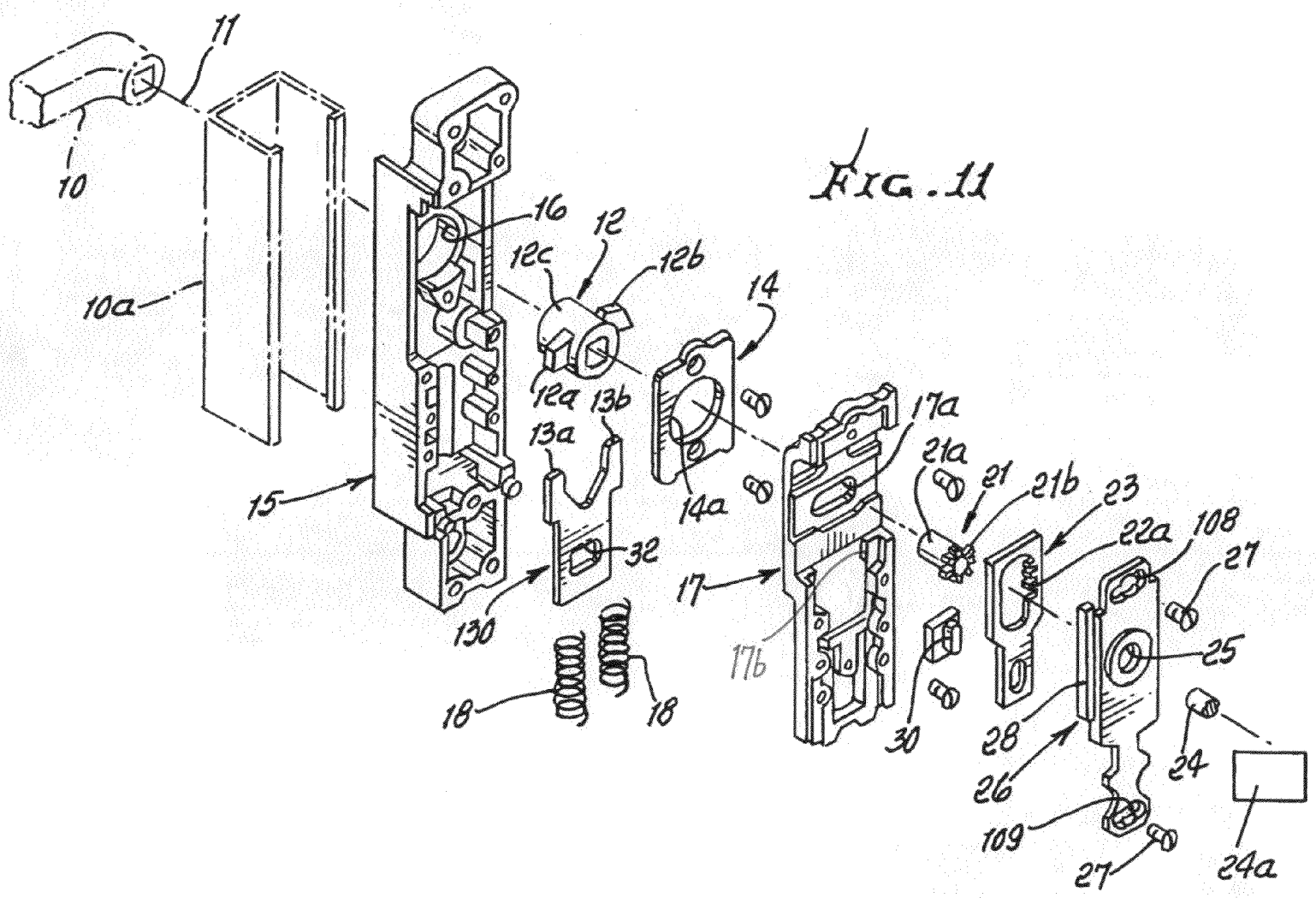

FIGS. 5*a* and 9*a* are elevations showing exterior and interior door handles;

FIG. 6 is a view similar to FIG. 5, but after removal of a rack plate;

FIG. 7 is a view like FIG. 4, but showing an adjustable cover, shifted laterally relative to a housing;

FIG. 8 is a view like FIG. 5, but showing the rack shifted laterally, relative to the housing;

FIG. 9 is a view like FIG. 5, but showing the rack having reversed position to correspond to door handle selected rotation in the opposite direction;

FIG. 10 is a schematic fragmentary edge view showing layered relation of rack, link plate, and housing elements; and FIG. 11 is an exploded perspective view showing housing, cover and drive train elements.

DETAILED DESCRIPTION

Referring first to FIG. 11, showing a preferred form of the invention, it will be seen that a door handle 10 is rotatable about an axis 11, to rotate a drive cam 12 in either direction about that axis. Door trim is shown at 10*a* The cam has two drive lobes 12*a* and 12*b* at opposite sides of axis 11, and that face downwardly to engage either of the shoulders 13*a* and 13*b* of a link plate 130 or driving that plate downwardly against tension springs 18, thereby responding to door handle rotation in either direction. Those springs urge plate 130 upwardly to seat shoulders 13*a* and 13*b* against respective lobes 12*a* and 12*b*. Thus, the springs or spring means urge the link and cam toward neutral position as seen in FIG. 6. A guide plate 14 has an intermediate through opening 14*a* to fit over the cam and guide its rotation.

A housing 15, connected to the door 100 to operate latch 104 and/or dead bolt 105 (see FIG. 2) has an intermediate through opening 16 to receive cam portion 12*c*. A housing cover 17 is adapted to connect and fasten to 15. Cover 17 defines a laterally elongated slot 17*a* that receives shaft 21*a* of a gear 21, and allow lateral shifting of a center of rotation of the gear relative to cover 17. Gear 21 has teeth 21*b* that mesh with the longitudinally spaced teeth 22*a* of a rack plate 23, whereby, as the rack is displaced longitudinally downwardly, the gear is rotated to rotatably drive a lock part 24. The lock is schematically shown at 24*a*. Part 24 is carried in an opening 25 in a laterally adjustable cover 26, that adjustable moves laterally with the rack, to an adjusted position, after which fasteners 27 are tightened to connect the cover 26 to the cover 17. Rail 28 on cover 26 extends longitudinally to slidably engage the longitudinal edge of the rack, to guide its movement longitudinally.

The cover 17 has a through opening 17*b* to receive a connector 30. Connector 30 fits in a recess 31 in the rack plate, as well as in a recess 32 in the link plate 130. As the link plate is displaced longitudinally, the connector 30 displaces the rack plate downwardly or upwardly. Link plate 13 does not move, i.e. shift laterally, but recess 32 is laterally elongated and allows "lost motion" lateral adjustable shifting of the connector 30, as the rack and cover 26 are corresponding adjustably shifted laterally. This allows lateral shifting of elements of the drive train, upon installation, to adjust the parallel axes of the handle 10 and lock part 24, to enable drive from the handle to part 24 even though such axes may be out of alignment. Cover 17 and/or cover 26 may be regarded as a rack carrier.

Figure 1:
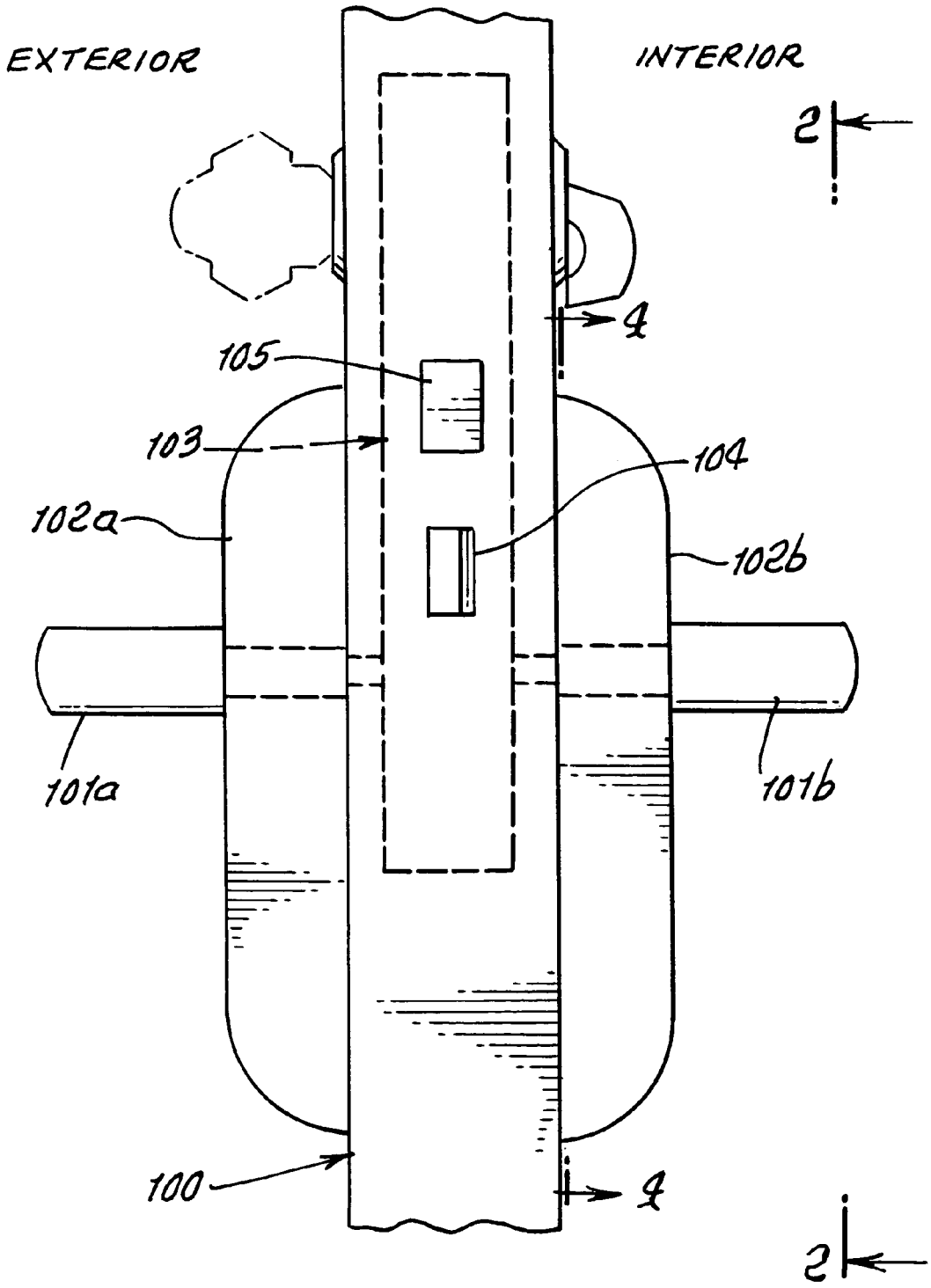
FIG. 1 is an edge view of a door incorporating apparatus according to the invention.
Figure 2:
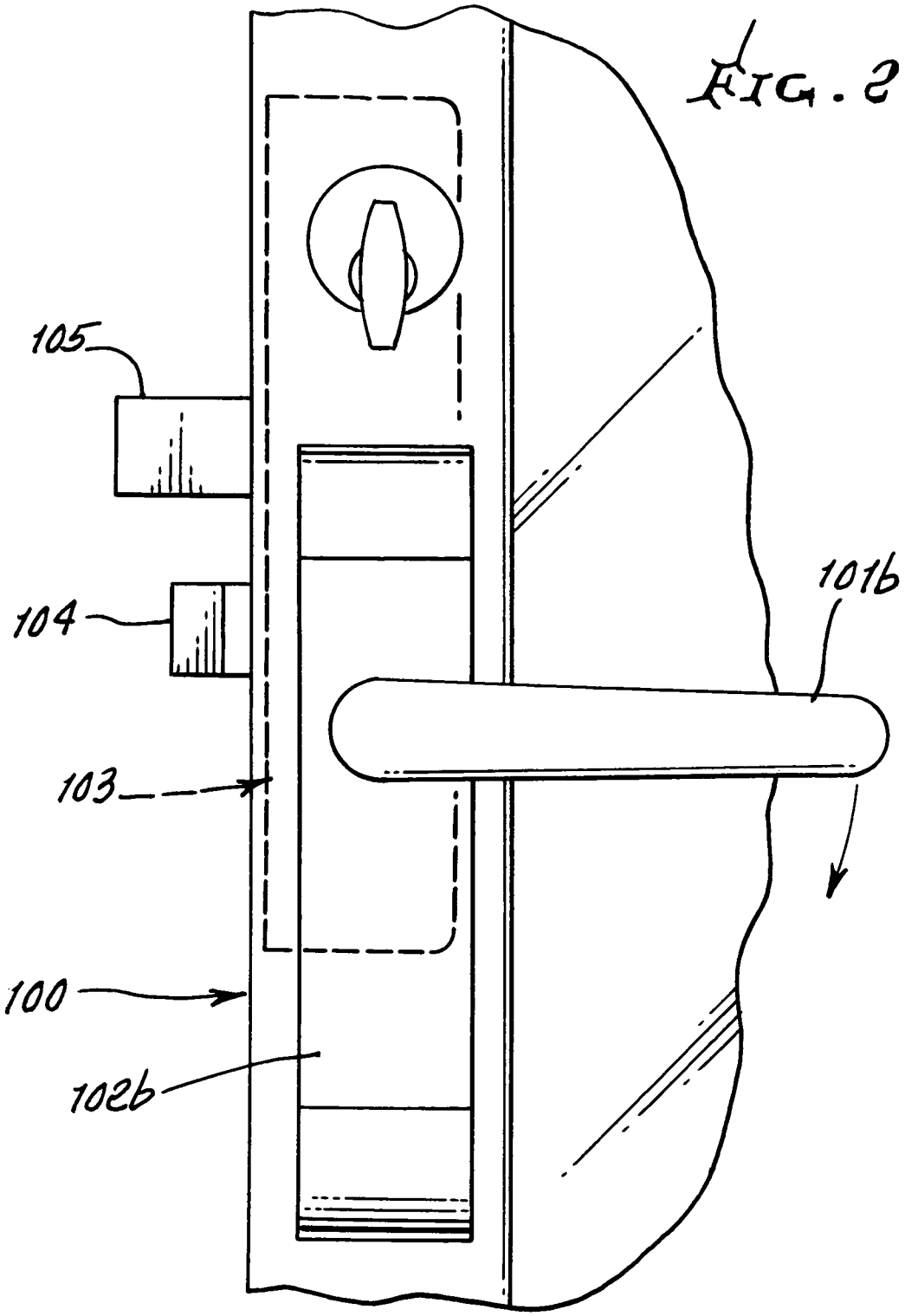
FIG. 2 is a frontal elevation taken on lines 2-2 of FIG. 1.
Figure 3:
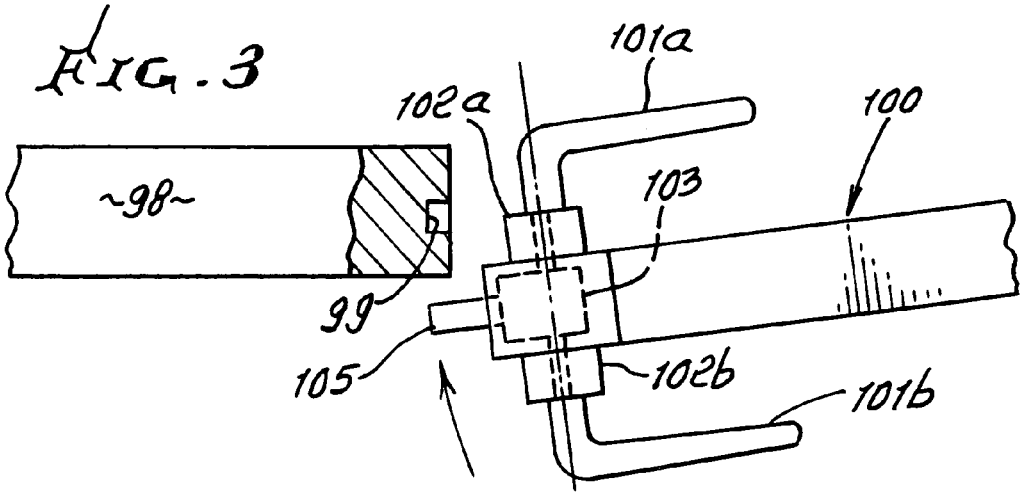
FIG. 3 is a fragmentary plan view showing door and wall structure in relative to lock and door handle elements.

Referring to FIGS. 1-3, a door 100 is schematically shown having like handles 101*a* and 101*b* at its opposite sides. These correspond to handle 10 in FIG. 11. Associated trim is shown at 102*a* and 102*b*. The door lock is indicated at 103, and latch 104 and dead bolt 105 are shown. See also FIGS. 5*a* and 5*b*, showing door hinging at 106. FIG. 3 shows wall 98 with latch or bolt recess 99.

FIG. 4 shows the adjustable cover 26 in one laterally adjusted position; and FIG. 7 shows cover 26 in a laterally shifted, and adjusted position. Fasteners 27 extend through vertically spaced, laterally elongated slots 108 and 109 in the cover 26 to connect to cover 17, allowing relative lateral shifting of 26 relative to 17, for example to FIG. 7 position.

In FIG. 5, the cover 26 has been removed, to show rack 23, with a vertically and longitudinally extending series of teeth 110, meshing at the right with the teeth 111 of gear 21. In FIG. 9, the position of the rack has been reversed, so that the rack teeth, moved at the left, mesh with the gear teeth. This enables reversal in the direction of turning of the handle about axis 11, as may be desired, at installation on a door. See also the disclosure in U.S. patent application Ser. No. 12/384,948 filed Apr. 10, 2009, incorporated herein by reference.

FIG. 6 shows, in frontal view, the link plate 130, drive cam 12, connector 30, slot 32 in 130, and return springs 18.

FIG. 8 is a view like FIG. 5, but showing the rack 23 in a relatively laterally shifted position. FIG. 10 schematically shows layered and spaced relations of the housing 15, link plate 130, and rack 23. It also shows the connector 30 interconnecting the link plate and rack, as via slot.

I claim:

1. In a drive train between a door handle having a first axis of rotation and a rotary lock carried on a door having a second axis of rotation, said drive train accommodating possible misalignment of said axes, the drive train including:

a) a carrier, b) a rack movable in a first direction relative to said carrier in response to door handle rotation, c) a gear having a center of rotation and configured to rotatably drive said rotary lock in response to rack movement in said first direction, d) a link having a drive connection to the rack for movement of the rack in said first direction, and a lost motion connection to the rack in a second direction generally perpendicular to said first direction, wherein said rack is permitted to move relative to said link in said second direction by said lost motion, wherein said gear maintains engagement with said rack when said rack is permitted to move relative to said link in said second direction by said lost motion, and wherein said center of rotation of said gear is configured for being selectively positionable relative to said carrier in said second direction.

2. The drive train of claim 1, wherein said first and second axes are parallel and misaligned.

3. The drive train of claim 1 including means on the carrier to support the rack for adjustable bodily movement laterally relative to the carrier in said second direction when said first and second axes are misaligned.

4. The drive train of claim 1 wherein the link and rack have a tongue and groove connection to provide said lost motion connection.

5. The drive train of claim 1 wherein the carrier includes a housing, and there being an adjustable cover adjustably attached to the housing, the adjustable cover guiding movement of the rack in said first direction, the cover having selectable lateral positioning relative to the housing.

6. The drive train of claim 5 wherein said housing includes an elongated slot defined therein configured for receiving said gear, wherein said gear is configured for being selectively positioned within said elongated slot.

7. The drive train of claim 6 wherein said gear is configured for being selectively positioned within said elongated slot relative to said housing in said second direction.

8. The drive train of claim 1 further comprising a connector coupling the rack to the link via the carrier, wherein said connector has a first lobe engaged with said rack to provide drive motion in said first direction and a second lobe engaged with said link to provide lost motion adjustability in said second direction.

9. The drive train of claim 1 further comprising a cam movable by the door handle to drive the link in said first direction.

10. The drive train of claim 9 wherein said cam has laterally spaced drive lobes engagable by the link in response to cam rotation in opposite directions by the door handle, whereby the lock is responsive to open the door, in response to handle rotation clockwise or counterclockwise.

11. The drive train of claim 10, including at least one spring urging the link and cam toward neutral position, relative to the door handle position.

* * * * *